United States Patent [19]

Danko et al.

[11] Patent Number: 4,916,353

[45] Date of Patent: Apr. 10, 1990

[54] INCANDESCENT LAMP UTILIZING CYLINDRICAL TRANSPARENT HEAT MIRROR

[75] Inventors: George K. Danko, Moreland Hills; Frederick A. Mosby, Shaker Heights, both of Ohio

[73] Assignee: General Electric Company, Schenectady, N.Y.

[21] Appl. No.: 317,242

[22] Filed: Feb. 28, 1989

[51] Int. Cl.[4] ..... H01K 1/18; H01K 1/34

[52] U.S. Cl. ..... 313/113; 313/25; 313/579; 313/580; 313/275; 313/279

[58] Field of Search ..... 313/578, 579, 580, 315, 313/271, 275, 278, 279, 277, 113, 25, 274

[56] References Cited

U.S. PATENT DOCUMENTS

| | | | |
|---|---|---|---|
| 3,168,670 | 2/1965 | Levand, Jr. | 313/274 |
| 4,060,423 | 11/1977 | Thomas | 106/52 |
| 4,420,801 | 12/1983 | Reiling et al. | 362/297 |
| 4,441,051 | 4/1984 | Thomas | 313/579 |
| 4,494,176 | 1/1985 | Sands et al. | 362/297 |
| 4,517,491 | 5/1985 | Otto et al. | 313/579 |
| 4,569,867 | 2/1986 | Noe | 428/35 |
| 4,710,676 | 12/1987 | Morris et al. | 313/580 X |
| 4,743,803 | 5/1988 | Lanese et al. | 313/579 |

*Primary Examiner*—Kenneth Wieder

*Attorney, Agent, or Firm*—John P. McMahon; Stanley C. Corwin; Fred Jacob

[57] ABSTRACT

Improved support means are provided to center the filament light source of an incandescent lamp within an open-ended transparent cylinder coated with an infrared reflecting film. Such filament mount construction is adapted for use in a tungsten-halogen lamp. A reflector lamp utilizing the improved tungsten-halogen lamp as a light source is also disclosed.

17 Claims, 3 Drawing Sheets

Fig. 1
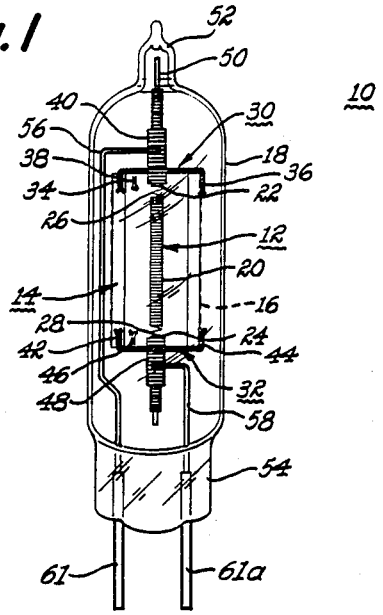
Fig. 2(a)
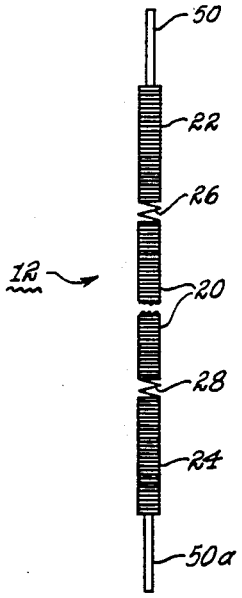
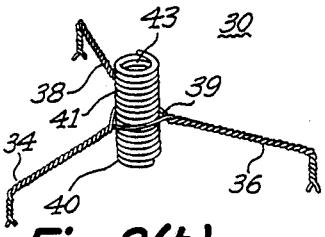
Fig. 2(b)
Fig. 2(c)
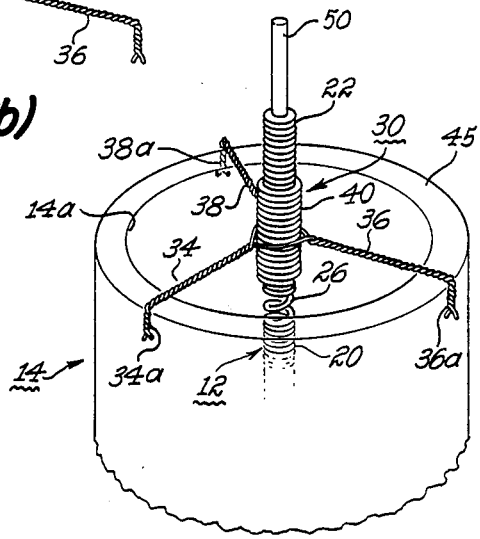

Fig. 3
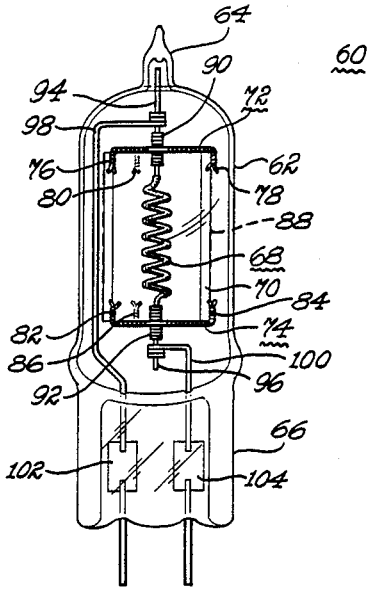
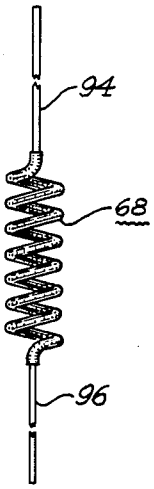
Fig. 4(a)
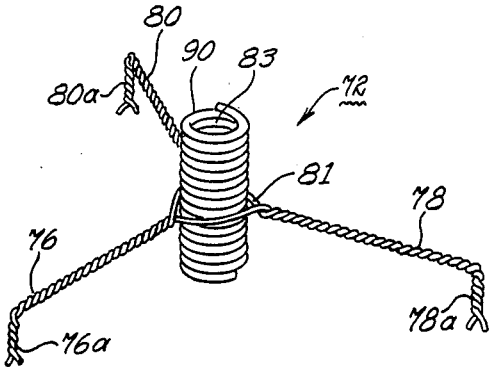
Fig. 4(b)

INCANDESCENT LAMP UTILIZING CYLINDRICAL TRANSPARENT HEAT MIRROR

BACKGROUND OF THE INVENTION

This invention relates generally to an incandescent lamp filament mount construction and more particularly to physical support means for a hollow open-ended transparent cylinder coated with an infrared reflecting film and surrounding the lamp filament which also centers the filament within the cylinder.

An already known means to increase the efficacy or operating efficiency of an incandescent lamp is to surround the filament light source with an open-ended transparent cylinder coated with an infrared reflecting film. Such a lamp construction is disclosed in U.S. Pat. No. 4,517,491, which is assigned to the assignee of the present invention, and the particular lamp construction incorporating such efficiency improvement means is a tungsten-halogen lamp. In one embodiment, the hollow transparent cylinder is provided with a sufficient size internal opening so as to further incorporate one of the lead-in conductors connected to the lamp filament and with the cylinder being physically supported within the lamp envelope by an outward protruding bulge provided in said lead-in conductor. In an alternate embodiment, this lead-in conduct extends longitudinally outside the cylinder with an inward protruding bulge section providing physical support thereto by urging the cylinder against an inner wall of the lamp envelope.

Centering of the lamp filament within the coated cylinder so as to provide a coaxial alignment therebetween is of considerable importance. For the infrared coating on the cylinder to be effective it is essential for the reflected energy to be focused back upon the lamp filament. For this optical criteria to be satisfied, it becomes understandably further necessary that the lamp filament be precisely located at the cylinder center since even minor deviations therefrom causes the reflected infrared rays not to impinge upon the filament. Considerable lamp efficacy losses are encountered due to any misalignment thereby further dictating that a precise coaxial alignment between the lamp filament and coated cylinder be maintained throughout the operating lamp life. While it becomes possible for some infrared rays which do not impinge upon the lamp filament to be subsequently redirected to the filament after multiple reflections, there will be considerable efficacy losses experienced with such mode of lamp operation.

Accordingly, it is an object of the present invention to provide improved means for accurate filament orientation within a coated cylinder providing higher operating efficiency in a tungsten-halogen lamp.

It is another object of the present invention to provide improved means whereby the lamp filament is more precisely centered within a coated cylinder employed to improve efficacy in a tungsten-halogen lamp.

Still another object of the present invention is to provide a tungsten-halogen lamp employing a cylinder coated with an infrared reflecting film which cooperates more effectively with the lamp filament to provide greater lamp operating efficiency.

Still another object of the present invention is to provide an improved reflector lamp employing an inner tungsten-halogen lamp as the light source wherein the tungsten-halogen lamp imparts higher operating efficiency to the overall lamp construction.

These and other objects of the present invention will become more apparent upon consideration cf the following detailed description for the present invention.

SUMMARY OF THE INVENTION

In general and in accordance with one aspect of the present invention, various refractory metal wire configurations have now been discovered enabling the filament light source in a tungsten-halogen lamp to be more precisely located along the central axis of a light transmissive cylinder coated with an inflated reflecting film which is disposed within the lamp envelope. Such centering means further suspends the coated cylinder within the lamp envelope so as to retain the desired filament orientation throughout lamp life. Additionally, the firmly secured coated cylinder in the present filament mount construction imparts a greater mechanical strength to the overall lamp assembly. The present lamp filament mount construction thereby comprises in combination (a) an axially extending tungsten filament coil physically suspended between a pair of lead-in conductors, (b) an open-ended light transmissive cylinder surrounding the tungsten filament coil and extending substantially its entire length, The cylinder having one of its major surfaces coated with an infrared reflecting film, and (c) refractory metal wire centering means disposed at each end of the cylinder, each centering means employing at least three wire lengths extending radially outward from the tungsten filament coil and being secured at the outer ends to a cylinder wall. Centering the filament coil within the reflecting cylinder in such manner avoids having any physical obstructions within the annular free space which could interrupt infrared transmission to the reflecting surface or its return to the filament coil. Another advantage achieved with the present centering means is eliminating need for further critical filament coil alignment within the lamp envelope. A still further advantage achieved with the present centering means is a more precise alignment of the coated cylinder with respect to the lighted length of the filament coil.

Various tungsten-halogen lamp configurations can employ the present filament mount construction. one such type tungsten-halogen lamp is disclosed in U.S. Pat. No. 4,743,803, also assigned to the present assignee, wherein such lamp employs a tubular sealed envelope formed of a light transmissive material which contains a rare gas fill including a halide compound along with an axially aligned tungsten filament. Such lamp envelope can be formed of glass to have the enclosed tungsten filament coil being suspended between refractory metal lead wires further sealed in a press seal region of the lamp envelope. Alternately, such lamp envelope can be formed with quartz glass having the refractory metal lead wires sealed in the lamp envelope with interconnection to refractory metal foil elements. A still different type lamp envelope now being employed in tungsten-halogen lamps for automotive headlamp applications can also be modified for use in accordance with the present invention. More particularly, a lamp envelope of this type the present assignee and features exhaust means being provided at the stem press end of the lamp envelope rather than as previously located at the opposite end. Correspondingly, various lamp filament coil constructions are suitable for the present tungsten-halogen lamp as dictated by the desired lamp operating requirements. A primary coil configuration generally satisfies low voltage type applications whereas a coiled coil type lamp filament is generally employed for lamp operation at ordinary household voltages. Double ended type tungsten-halogen lamp configurations can also be adapted for practice of the present invention. According, there is disclosed in further commonly assigned U.S. Pat. No. 4,060,423, an elongated tubular lamp envelope fabricated with quartz glass or other suitable refractory glass material having a longitudinally extending tungsten filament suspended at each end of the lamp envelope with sealed in lead conductors. Still another double ended lamp configuration as disclosed in further commonly assigned U.S. Pat. No. 3,168,670 would be structurally modified according to the present invention by replacing the filament support means therein disclosed with the herein contemplated filament mount construction.

Generally, in another additional form of the present invention, a representative reflector lamp comprises (a) an outer reflector envelope housing an inner incandescent lamp disposed adjacent to the focal point, (b) the inner incandescent lamp comprising a tubular light transmissive lamp envelope having an axially extending tungsten filament coil physically suspended between a pair of lead in conductors hermetically sealed therein, (c) the inner lamp envelope further containing an inert gas fill which includes a vaporizable halogen substance, (d) an open-end light transmissive cylinder surrounding the tungsten filament coil within the inner lamp envelope and extending substantially its entire length, the cylinder having one of its major surfaces coated with an infrared reflecting film, and (e) refractory metal wire centering means disposed at each end of the cylinder within the inner lamp envelope, each centering means employing at least three wire lengths extending radially outward from the tungsten filament coil and being secured at the outer ends to a cylinder wall. The outer reflector lamp envelope can be a ribbon blow glass member such as disclosed in still further commonly assigned U.S. Pat. No. 4,569,867 which is fabricated with a curved reflector portion closed by an integral flattened face portion proceeding from a cylindrical neck portion that is also sealed to a conventional screw type base. Alternately, the outer reflector lamp envelope can have a molded glass construction employing a curved reflector sealed at the bottom end to a conventional base and closed at the front end by a glass cover member. Typical reflectors of this latter type are disclosed in U.S. Pat. No. 4,420,SO1 to Reiling et al and U.S. Pat. No. 4,494,176 to Sands et al, both assigned to the present assignee. The concave reflector members therein disclosed include both a parabolic section and a spherical section with the filament light source being disposed approximately at the common focal point. Both reflectors further include a lens or cover plate enclosing the reflector member and there is further mentioned optional employment of a tungsten-halogen incandescent lamp as a suitable light source in such type lamps.

In all of the above illustrated lamp constructions, the present lamp filament mount construction is formed by first securing a pre-assembly of the refractory metal centering wires at opposite ends of the filament coil and thereafter joining the outer ends of the attached radially extending wire lengths to opposite ends of the coated cylinder walls. Having the outer ends of the centering wires provided with suitable bends enables the cylinder to be snapped in place during lamp manufacture as well as thereafter providing sole physical support of the cylinder within the lamp envelope. Attachment of the respective centering wires to the lamp filament coil can simply be carried out by winding an assembly of the radially extending wire elements tightly about the circumference of a refractory metal eyelet and the joining such pre-assembly to the filament coil ends. For example, a pair of such centering wire pre-assemblies can first be mechanically secured at the outer ends of the spud wires commonly employed for filament coil termination and thereafter suitably welded in place. An alternative means contemplated for attachment of such centering wire preassemblies to opposite ends of the filament coil can be carried out particularly with respect to filament coils wound to have a center lighted section with spaced apart or open turn end segments of unlighted coil length. More particularly, the respective centering wire pre-assemblies can be joined to the unlighted segments at each end of such filament coils such as by first mechanically urging the eyelet openings directly over these end coil turns and thereafter welding the mechanically assembled eyelets in place.

BRIEF DESCRIPTION OF THE DRAWINGS

FIG. 1 is a front view depicting a representative tungsten-halogen lamp employing the presently improved lamp filament mount construction.

FIG. 2 comprising FIGS. 2(*a*), 2(*b*) and 2(*c*) illustrates related features to the construction of the lamp of FIG. 1.

FIG. 3 is a front view for a different representative tungsten-halogen lamp having the present lamp filament mount construction.

FIG. 4 comprising FIGS. 4(*a*) and 4(*b*) illustrates related features to the construction of the lamp of FIG. 3.

DETAILED DESCRIPTION OP THE PREFERRED EMBODIMENTS

Figure 5:
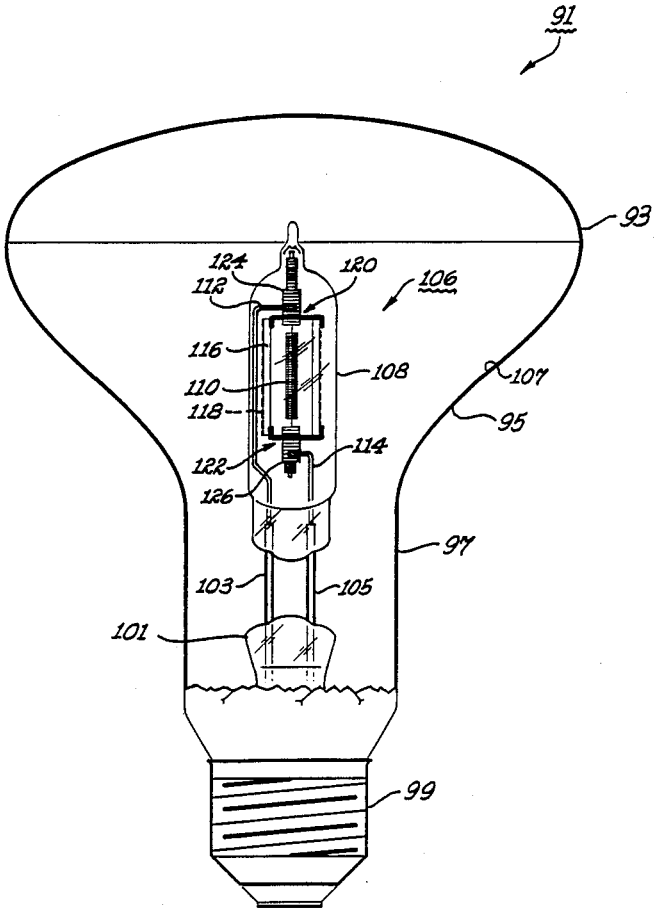
FIG. 5 is a representative reflector lamp partially in cross section embodying the present lamp filament mount means.

Referring to the drawings, FIG. 1 depicts a typical tungsten-halogen lamp 10 employing an axially aligned tungsten filament coil 12 centered within an open-ended light transmissive cylinder 14 coated with an infrared reflecting film 16 which is physically suspended within tubular lamp envelope 18. A coiled coil tungsten filament 12 of the segmented type is shown having a center lighted portion 20 with unlighted end portions 22 and 24 being joined to the center portion with respective open coil turns 26 and 28. As can also be noted, the length of coated cylinder 14 is coextensive with the lighted segment 20 of filament coil 12 in the illustrated lamp embodiment with the cylinder ends being physically supported entirely by individual refractory metal wire centering means 30 and 32 located thereat. Upper wire centering means 30 comprises three radially extending wire lengths 34, 36 and 38 wound together at the inner ends for engagement with a refractory metal eyelet 40. The outer ends of said wire lengths are bent to physically engage the outer circumference of coated cylinder 14 at its upper end. Similarly, lower wire centering means 32 employs three wire lengths 42, 44 and 46 again wound together at the inner ends to engage refractory metal eyelet 48 and having the outer ends bent for physical engagement with the lower outer circumference of the coated cylinder member 14. The tungsten filament coil 12 is further terminated at opposite ends by conventional "spudding" means whereby one of the spud ends 50 has been sealed into upper exhaust tip end 52 of the lamp envelope 18. Such lamp envelope can also be formed in a conventional manner from a length of cylindrical refractory glass tubing, such as aluminosilicate glass, to further include a stem press region 54. A pair of refractory metal lead-in conductors 56 and 58 physically suspending the joined together filament coil and cylinder assembly within the lamp envelope are connected to the refractory metal eyelet components of the wire centering means in doing so. The opposite ends of said lead-in conductors 56 and 58 are hermetically sealed within the lamp envelope at the stem press region 54 as well as being further connected thereat to larger diameter outer lead-in conductors 61 and 61*a*, respectively Such larger diameter lead-in conductors enable physical support of the entire lamp construction along with electrical connection to external lamp terminals again in the customary conventional manner.

FIG. 2 depicts a single centering wire means 30 before and after assembly to the tungsten filament coil 12 in the FIG. 1 lamp construction. Accordingly, the same numeral identification has been retained to identify common structural components in the present drawing. Proceeding from the left side to the right side in said drawing, there is first depicted at FIG. 2(*a*) a more detailed view of filament coil 12 prior to attachment of the wire centering means 30 thereto. As hereinabove explained, said filament coil 12 includes a central lighted segment 20 joined to unlighted end segments 22 and 24 by open coil turns 26 and 28. The unlighted end segments are terminated with spud wire lengths 50 and 50*a* which can both simply consist of residual mandrel wire lengths upon which the filament coil has been wound and which now function to electrically short the coil turns of the unlighted coil segments. The view of FIG. 2(*b*) the present drawing depicts wire centering means 30 prior to its joinder with the upper end of filament coil 12. Said wire centering means includes three substantially equispaced radially extending wire lengths 24, 36 and 38, as also herein above explained, which have been wound together to form a triangular shape opening 39. Said wire assembly is mechanically pressed at the central opening over the periphery of a refractory metal eyelet 40 formed as a cylindrical coil 41. The resulting wire centering means is next mechanically joined to filament coil 12 by pressing coil end 50 into the central opening 43 provided in the coiled eyelet 40. Conventional welding of said eyelet to the filament coil end permanently secures the assembled components together. The FIG. 2(*c*) view in the present drawing depicts a completed assembly of pre-assembled wire centering means 30 to the upper end 45 of coated cylinder 14. Bent ends 34*a*, 36*a* and 38*a* at the outer ends of the respective radially extending wire portions of said centering means grasp the outer peripheral wall surface of the coated cylinder whereupon the tungsten filament coil 12 now secured thereto becomes thereby positioned at the center of the hollow cylinder opening 14*a*. A like disposition of the pre-assembled lower wire centering means (not shown) at the bottom end of coated cylinder 14 provides a coaxial alignment of the suspended tungsten filament coil throughout the entire length of the coated cylinder.

FIG. 3 depicts a different representative tungsten-halogen lamp configuration 60 employing the present lamp filament mount construction. Accordingly, the lamp 60 comprises a tubular lamp envelope 32 formed with quartz glass tubing and having an exhaust tube end 64 along with a press seal end 66. Hermetically sealed within said lamp envelope 62 is an axially aligned tungsten filament coil 68 enclosed by a from the filament coil so as to provide a coaxial alignment therebetween. Again, wire centering means 72 and 74 are disposed at the upper and lower cylinder ends, respectively, to provide such support and centering with the wire centering means being physically secured to the lamp filament coil. Wire centering means 72 employs radially extending wire lengths 76, 78 and 80 physically engaging the upper cylinder wall whereas wire centering means 74 utilizes wire lengths 82, 84 and 86 at the lower cylinder end to complete such cylinder suspension. An infrared reflecting film 88 is also provided on the outer cylinder major surface to produce the desired improved lamp operating efficiency. The upper wiring centering means 72 is physically secured to lamp filament coil 68 with a refractory metal eyelet 90 while lower wiring centering means 74 is similarly secured by refractory metal eyelet 92. A spud element 94 further secures the joined together filament coil and coated cylinder at its upper end to the lamp envelope with lower end of said assembly including a second spud element 96. A first lead-in conductor 98 is joined to upper centering eyelet 90 while second lead-in conductor 100 is similarly joined to lower centering eyelet 92 to complete physical suspension of the assembled filament coil and coated cylinder within the lamp envelope. Both lead-in conductors are further hermetically sealed within the lamp envelope by interconnection to refractory metal foil elements 102 and 104 at the stem press end.

An unassembled view for upper wire centering means 72 employed in the preceding lamp embodiment is depicted in FIG. 4. As shown in FIG. 4(*a*), filament coil 68 comprises a coiled coil length of continuous tungsten wire physically joined at opposite ends to spud elements 94 and 96 in the customary manner. FIG. 4(*b*) shows the centering means as having a hollow coiled eyelet 90 joined to radially extending wire elements 76, 78 and 80 at a triangular opening 81 formed in the previously assembled wire lengths. Similarly, bends 76*a*, 78*a* and 80*a* are formed at the opposite ends of said wire lengths to grasp the outer circumference of the suspended coated cylinder (not shown). A central opening 83 in the eyelet coil 90 enables insertion of upper spud element 94 into the opening for joinder thereto with a weld thereafter being provided to permanently secure the assembled components together.

FIG. 5 depicts partially in cross section a representative reflector lamp construction 91 employing an inner tungsten-halogen lamp for its light source which further includes the present lamp filament mount construction. The reflector 91 comprises an enclosed blown glass outer envelope 93 of the type disclosed in the aforementioned U.S. Pat. No. 4,569,867 which includes a curved reflector portion 95 connected to a cylindrical neck portion 97 and sealed at the opposite end to a conventional screw base 99. Extending from the further conventional stem press region 101 of said outer envelope 93 is a first pair of lead-in conductors 103 and 105 physically supporting a tungsten-halogen lamp 106 positioned within said outer envelope for optical cooperation with reflecting surface 107. The reflecting surface customarily represents an approximately half section or slightly wider portion of a symmetrically parabolic reflector with the inner lamp filament being located adjacent the focal point of said reflecting surface. Tungsten-halogen lamp 106 can again be fabricated with a light transmissive refractory glass envelope 108 having an axially aligned tungsten filament coil 110 suspended between a second pair of refractory metal lead-in conductors 112 and 114 with said filament coil further being enclosed by a hollow light transmissive open-ended cylinder 116 coated with an infrared reflecting film 118. Again, refractory metal wire centering means 120 and 122 having the hereinabove structural configurations are joined to the filament coil 110 and cylinder ends in the same manner also above explained. Likewise, lead-in conductors 112 and 114 are secured respectively to refractory metal eyelets 124 and 126 included in the refractory metal wire centering means to complete a lamp filament mount construction physically supporting the coated cylinder and centering the lamp filament coaxially with the longitudinal cylinder axis. All of the herein illustrated tungsten-halogen lamp embodiments in PIGS. 1, 3 and 5 further include the customary rare gas fill containing a vaporizable halogen substance (not shown) in order to provide the well known regenerative tungsten cycle employed to extend lamp life and further increase lamp operating efficiency.

It will be apparent from the foregoing description that a generally improved filament mount construction has been provided to increase the efficacy of tungsten-halogen lamps. It will be apparent that modifications can be made in the specific contour and physical features of a particular tungsten-halogen lamp design other than above expressly illustrated, however, without departing from the spirit and scope of the present invention. Likewise, it is contemplated to employ a tungsten-halogen lamp having the presently improved filament mount construction for a light source in still different lamp units than above expressly described. Consequently, it is intended to limit the present invention only by the scope of the following appended claims.

What we claim as new and desire to secure by Letters Patent of the United States is:

1. An incandescent lamp filament construction for use in a tungsten-halogen lamp comprising in combination:

(a) an axially extending tungsten filament coil physically suspended between a pair of lead-in conductors, (b) an open-ended light transmissive cylinder surrounding the tungsten filament coil and extending substantially its entire length, the cylinder having one of its faces coated with an infrared reflecting film, and (c) refractory metal wire centering means disposed end of the cylinder, each centering means employing at least three wire lengths extending radially outward from the tungsten, filament coil and being secured at the outer ends to a wall of the cylinder.

2. The mount construction of claim 1 wherein the inner ends of the wire lengths are joined to an eyelet.

3. The mount construction of claim 1 wherein the outer ends of the wire lengths are bent so as to physically engage the outer cylinder wall.

4. The mount construction of claim 2 wherein the eyelet is secured to the tungsten filament with a welded connection.

5. The mount construction of claim 2 wherein the eyelet has a coiled configuration with a larger coil turn diameter than the coil turn diameter of the tungsten filament coil.

6. The mount construction of claim 1 wherein the tungsten filament coil comprises a coiled-coil tungsten filament of continuous wire having a central section serving as the lighted section of the filament coil in its energized condition with open turn segments at each end of said filament coil.

7. The mount construction of claim 6 wherein the inner ends of the refractory metal wire centering means are joined to open turn segments of the filament coil.

8. The mount construction of claim 2 wherein each lead-in conductor is physically joined to a refractory metal wire centering means.

9. The mount construction of claim 5 wherein the eyelet is physically joined to an end coil turn of the tungsten filament coil.

10. An improved incandescent lamp including:

(a) an elongated light transmissive lamp envelope having an axially extending tungsten filament coil disposed coaxially therein, the tungsten filament coil being physically suspended between a pair of lead-in conductors hermetically sealed therein, (b) the lamp envelope further containing an inert gas fill which includes a vaporizable halogen substance, (c) an open-ended light transmissive cylinder surrounding the tungsten filament coil within the lamp envelope and extending substantially its entire length, the cylinder having one of its major surfaces coated with an infrared reflecting film, and (d) refractory metal wire centering means disposed at each end of the cylinder within the lamp envelope, each centering means employing at least three substantially equal wire lengths spaced about the cylinder circumference which are secured at the inner ends to the tungsten filament coil while being secured at the outer ends to a wall of the cylinder.

11. The lamp of claim 10 wherein the lead-in conductors are hermetically sealed at opposite ends of the amp envelope.

12. The lamp of claim 10 wherein the lead-in conductors are hermetically sealed at the same end of the lamp envelope.

13. The lamp of claim 10 wherein the lead-in conductors are hermetically sealed with press seal means.

14. The lamp of claim 13 wherein the lead-in conductors are joined to larger diameter lead-in conductors in the press seal region of the lamp envelope.

15. The lamp of claim 10 wherein the lamp envelope is formed with quartz glass.

16. The lamp of claim 15 wherein the lead-in conductors are hermetically sealed in the lamp envelope with thin refractory metal foil elements.

17. An improved reflector type lamp comprising:

(a) an outer reflector envelope housing an inner incandescent lamp disposed adjacent to the focal point, (b) the inner incandescent lamp comprising a tubular light transmissive lamp envelope having an axially extending tungsten filament coil physically suspended between a pair of lead-in conductors hermetically sealed therein, (c) the inner lamp envelope further containing an inert gas fill which includes a vaporizable halogen substance, (d) an open-ended light transmissive cylinder surrounding the tungsten filament coil within the inner lamp envelope and extending substantially its entire length, the cylinder having one of its major surfaces coated with an infrared reflecting film, and (e) refractory metal wire centering means disposed at each end of the cylinder within the inner lamp envelope, each centering means employing at least three wire lengths extending radially outward from the tungsten filament coil and being secured at the outer ends to a wall of the cylinder.

* * * * *